US006247781B1

(12) United States Patent
Blum

(10) Patent No.: US 6,247,781 B1
(45) Date of Patent: Jun. 19, 2001

(54) INK JET PRINTHEAD WITH AN IMPROVED EYELID SYSTEM

(75) Inventor: John N. Blum, Kettering, OH (US)

(73) Assignee: Scitex Digital Printing, Inc., Dayton, OH (US)

( * ) Notice: Subject to any disclaimer, the term of this patent is extended or adjusted under 35 U.S.C. 154(b) by 0 days.

(21) Appl. No.: 09/211,250

(22) Filed: Dec. 14, 1998

(51) Int. Cl.[7] ..... B41J 2/165
(52) U.S. Cl. ..... 347/29; 347/22; 347/75
(58) Field of Search ..... 347/74–75, 108, 347/170, 215, 23, 29, 30, 22; 358/296; 400/693; 399/8, 13; 361/610, 611, 615, 616

(56) References Cited

U.S. PATENT DOCUMENTS 4,000,693 * 1/1977 Kaiser et al. ..... 101/183
5,648,803 * 7/1997 Koyama et al. ..... 347/30

FOREIGN PATENT DOCUMENTS 0805 030 A2 * 11/1997 (EP) ..... B41J/2/165
410034942A * 2/1998 (JP) ..... B41J/2/16

* cited by examiner

*Primary Examiner*—N. Le
*Assistant Examiner*—Hai C. Pham
(74) *Attorney, Agent, or Firm*—Barbara Joan Haushalter

(57) ABSTRACT

A technique for sealing a printhead of an ink jet printer system on startup, opening the seal to print, and opening further on an arbitrary path for cleaning, is provided for by the present invention. The ink jet printhead has an ink drop generator, a catcher located adjacent to the ink drop generator, and a catcher pan located below the catcher. An eyelid seals ink within the printhead on startup of the printer system. An actuator mechanism transmits movement to the eyelid along a predetermined non-circular path, having multiple positions for the eyelid. A multiple bar linkage system moves the eyelid along the path.

17 Claims, 5 Drawing Sheets

INK JET PRINTHEAD WITH AN IMPROVED EYELID SYSTEM

TECHNICAL FIELD

The present invention relates to the field of continuous ink jet printing and, more particularly, to the startup and servicing of printheads.

BACKGROUND ART

In continuous ink jet printing systems, the eyelid is a moveable seal which diverts ink on startup into the catcher, thereby recycling the ink while containing it within the printhead. The seal is formed against the lip of the metal catch plate, which is typically about 0.025 inches thick. The eyelid opens about 0.04 inches while the printer is printing, allowing the ink drops to pass onto the print media. The area behind the eyelid, containing the droplet generator and charging leads, is frequently accessed for cleaning over the life of a printhead.

The printhead is typically located over the top of a roller carrying the print media, with the ink drops moving downward in a roughly vertical direction. To assure good print quality, the printhead is 0.075 to 0.100 inches above the substrate. The eyelid must seal perpendicular to the drop path while not contacting the moving substrate on the roller. The motion paths of prior art have been limited to a linear sliding, or a single pivot. The linear paths of some prior art are guided by slots which are prone to collecting ink residue, leading to sticking or jamming of the eyelid.

Prior eyelids have used simple spring loaded solenoid actuators. The spring maintains the seal force until the solenoid opens it to a print position. However, the solenoid may create an excessive shock when the eyelid opens and impacts its print position stop. This shock jars the ink jet printhead, causing the printhead to malfunction. To prevent this, cushioning springs or rubber dampers are used to buffer the impact of the eyelid and solenoid plunger at the end of its travel.

Both the linear slide and the simple pivot eyelids are suitable for a seal moving a small distance from the sealed position to the print position. These configurations, however, do not move far enough to allow the operator to look at the jets and charging electrodes in a horizontal direction while they are cleaning the printhead. It is therefore necessary for the eyelid to be removed by a trained operator for printhead cleaning. This may entail removing screws and covers, necessitating the use of a tool for fasteners and the possibility that the parts may be lost or damaged on reassembly. Proper alignment of the sealing edge with the catchplate may be difficult to obtain after repeated disassembly, leading to leaks or poor startups.

An additional safety issue exists, since the printhead contains high voltage (~150 Volts). While operating, it is necessary to maintain proper ingress protection to avoid accidental contact with the charging electrodes. In the existing art the removal of covers by trained service personnel is the only means provided to prevent accidental access to the electrodes while the high voltage is on. With the cover removed, the eyelid may be removed, allowing accidental access to the high voltage during printhead operation. The system has no means to detect this operator override of the manufacturer's design or disable operation until it is corrected.

As mentioned earlier, it is possible for the eyelid to stuck or jammed. The prior art, with a simple solenoid actuator, has no feedback of eyelid position or presence. If the eyelid jams while closing, no indication is made to the system of the malfunction. This could result in ink spraying out of the printhead during start up or shut down.

In view of the weakness outlined in the prior art, it is therefore an object of the present invention to provide a means for sealing a printhead on startup, opening the seal to print, and opening further on an arbitrary path for cleaning. This is to be performed without the need for tools or removal of printhead parts.

It is another object of the present invention to provide such a seal means which minimizes mechanical shock as the seal and related parts move.

It is yet another object of the present invention to provide an interlock of the charge lead voltage to the eyelid position to protect the operator from electrical shock. The interlock is also designed to keep the high voltage off if the eyelid is removed from the printhead.

Finally, it is another object of the present invention to provide a means of feedback to the print station indicative of eyelid presence and position. Eyelid closure, proper print opening and service position are to be checked, allowing an eyelid malfunction to be detected.

SUMMARY OF THE INVENTION

These needs are met by the eyelid system of the present invention.

In accordance with one aspect of the present invention, the eyelid system comprises a means of actuating an eyelid with a motor, thereby providing multiple positions for the mechanism; a means of guiding eyelid position with a four-bar mechanism, allowing complex yet precise motion paths; a means of determining the position of the eyelid by using switches, including a compact means to adjust the operating position of these switches; a means to provide a safety interlock that will disable the high voltage charging electrodes if the eyelid is opened too far, which feature functions independently of the eyelid motor or other position switches; and a means of heating the body of the eyelid to prevent the formation of condensate from heated ink.

Other objects and advantages of the invention will be apparent from the following description, the accompanying drawing and the appended claims.

DETAILED DESCRIPTION OF THE PREFERRED EMBODIMENTS

Figure 1:
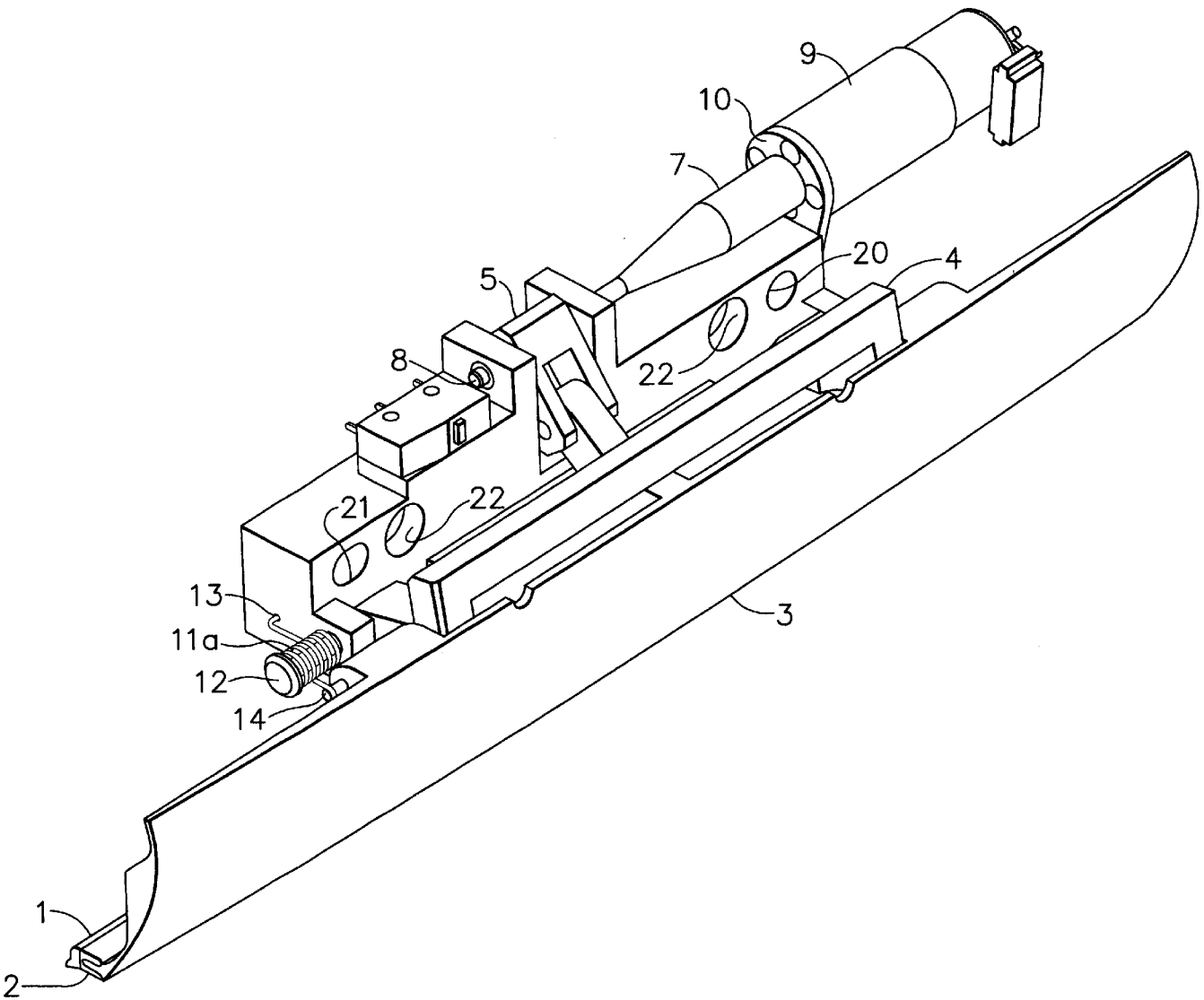
FIG. 1 is an isometric view of an eyelid system constructed in accordance with the present invention.

Referring to FIG. 1, the present invention comprises a seal 1, bonded to a metal insert 2, placed on to an eyelid body 3. The eyelid body is in turn pinned or otherwise attached to a rocker 4 and crank 5. The rocker is pinned or otherwise associated with a base 6. The crank is fixed to shaft extension 7. The shaft extension is located in the base by suitable means such as bushings 8, and connected to motor 9. The motor is attached to the base by motor mount plate 10.

The assembly is preloaded by two torsion springs 11*a* and 11*b*, mounted at opposing ends of pins 12 fastening the rocker to the base. One end of the spring 11*a* is fixed in an aperture 13 in the base, while the opposing end bears on rocker/eyelid pin 14. Preloading the mechanism biases all pivot clearances in a predictable way. Additional sealing force is also obtained from the springs.

The assembly forms a 4-bar linkage with the base as the ground. The crank is the driver, the eyelid is the connecting link and the rocker the driven link. This allows a substantially horizontal motion while sealing against the catchplate and a vertical motion to give the operator access for service.

Figure 2:
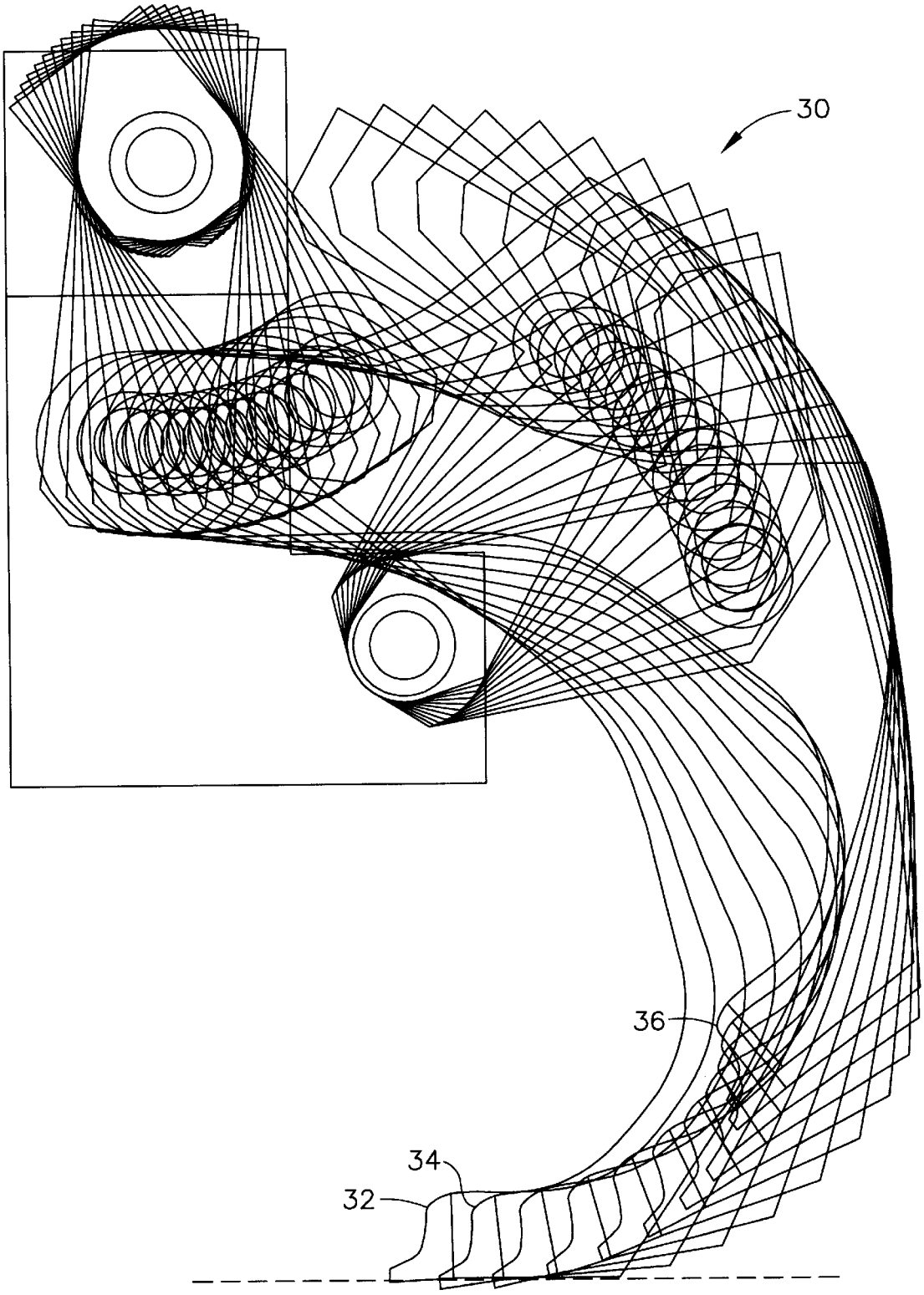
FIG. 2 illustrates the path swept by the eyelid of FIG. 1, as it moves through the operational positions.

The path 30 taken by the eyelid as it shifts from the sealed position 32 to the print position 34 to the service position 36 is shown in FIG. 2. As illustrated, the lower surface of the eyelid motion has minimal movement below the sealed position. Therefore the risk of the eyelid contacting the print media is minimized. The pivots for this four bar system are all located above the droplet generator, minimizing the risk of ink fouling up the mechanism.

The base is mounted on the printhead frame and is accurately located by means of two alignment pins in the printhead frame engaging hole 20 and oval 21. Captive screws in holes 22 fasten the eyelid to the frame. By such locating features, the consistency of alignment of the eyelid to the catch plate is ensured, assuring consistent sealing of the printhead.

In a preferred embodiment of the present invention, the actuator of the eyelid with the four bar linkage is a stepper motor. The stepper motor provides a holding torque required to hold the eyelid in each functional position, while the mechanism is in use. It will be obvious to those skilled in the art that alternative motors or motor/encoder combinations could be used to perform the same function as the stepper in this embodiment. By using the stepper motor as opposed to the solenoid actuation employed in the prior art, it is possible to locate the eyelid in more than just two positions. A desirable third position is a service position. This moves the eyelid much farther from the charge plate and orifice plate, allowing the operator to inspect these surfaces and perform manual cleaning steps as needed. Thus, it is no longer necessary to remove the eyelid to perform these functions.

In a preferred embodiment of the present invention, the stepper motor is a MicroMo Electronics (Clearwater, Fla.) AM1524 with a 159:1 planetary gear reducer. This stepper motor is preferred for its small size and large torque, 15 mm diameter and 42 oz-in respectively. Moving the eyelid from the sealed position to the print position involves stepping the motor through 45° of rotation. By controlling the actuation pulses to the stepper motor, the eyelid accelerations are controlled. The mechanical shocks produced by the solenoid actuations of the prior art are therefore eliminated.

Figure 3:
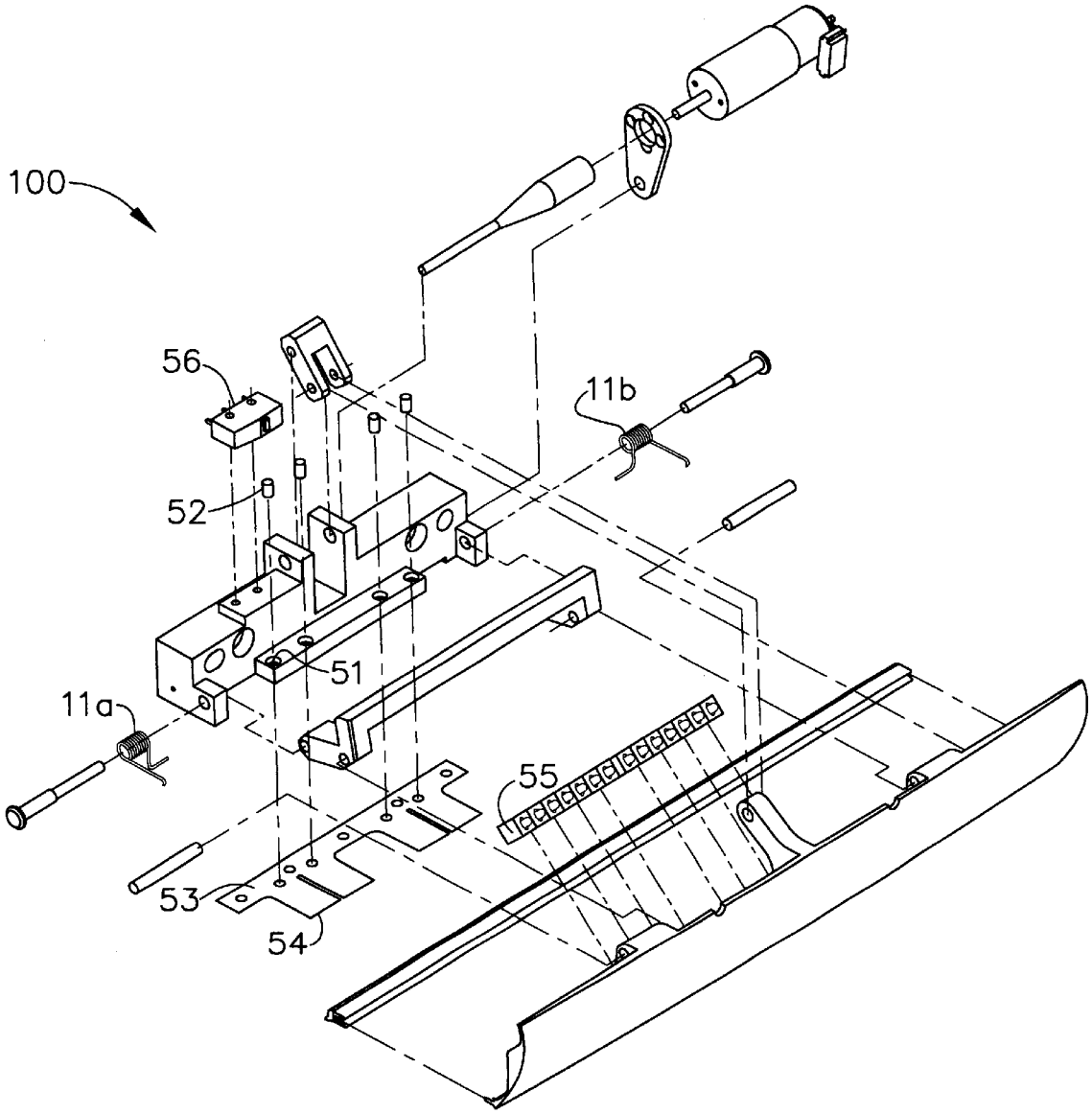
FIG. 3 is an exploded view of the eyelid assembly according to the present invention.
Figure 5:
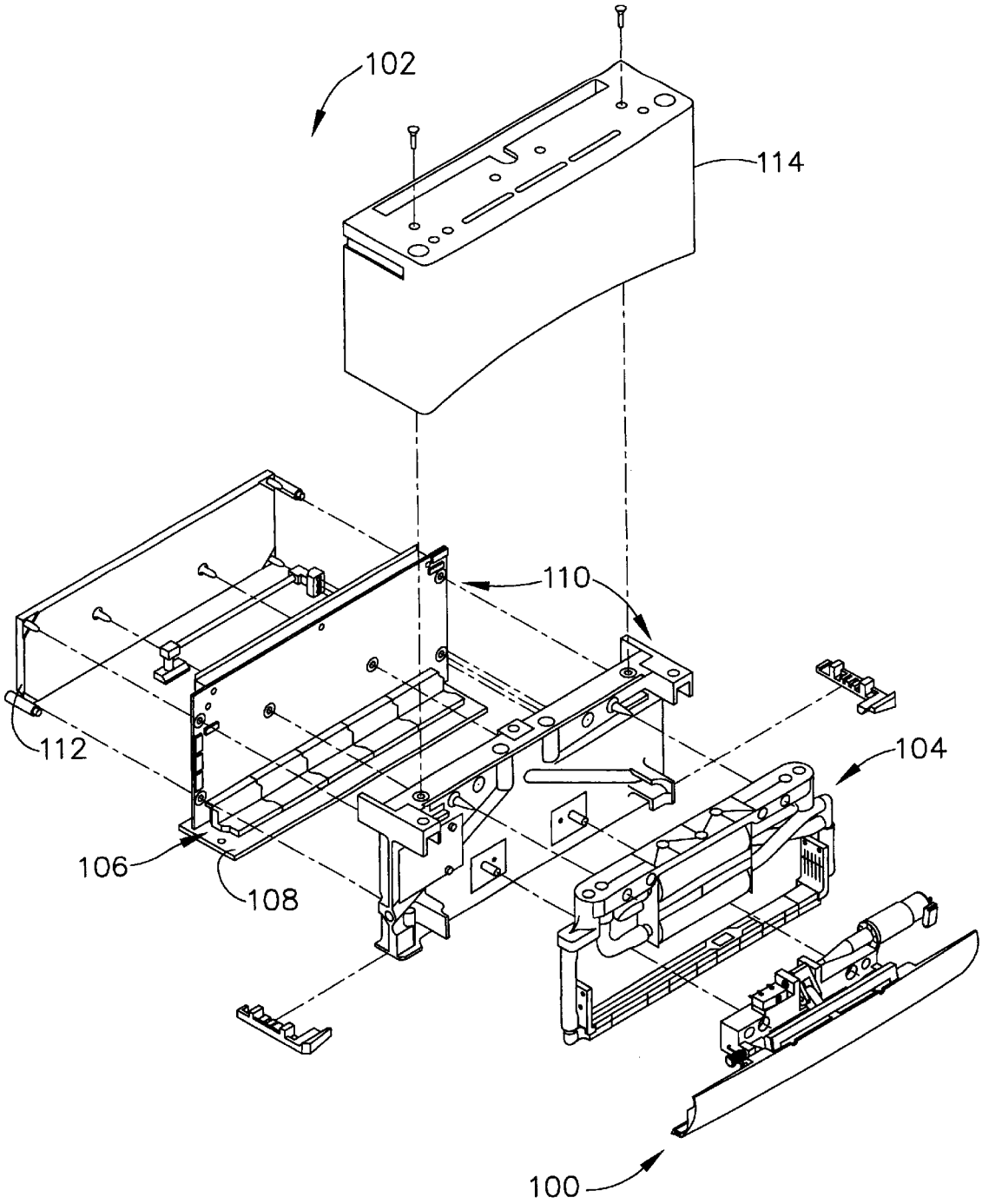
FIG. 5 is an exploded view of a printing system incorporating the eyelid assembly of this invention.

Referring now to FIGS. 3 and 5, ink jet printhead 100 accomplishes ink jet printing with droplet streams through a plurality of orifices in the drop generator 104, by selectively charging and deflecting some droplets from their normal trajectories. The ink is expelled from the orifices in jets 105 which break up due to surface tension in the ink into droplet streams. The deflected or undeflected droplets are caught and recirculated and the others are allowed to impinge on a printing surface. A catcher 106, including a catch pan 108, is used to catch and recirculate deflected drops. Switch means 55 attached to the eyelid body 3 are used to detect the eyelid in the closed and print positions. These switch means 55 are actuated by the fingers 54 of the actuator plate 53 which is attached to the base 6 when the eyelid is closed sufficiently. Multiple switch actuation positions are provided to determine eyelid closure and print position and to provide a high voltage interlock. One means to determining position is to have one switch open and another closed at the desired position. The motor controller can step open or closed as needed based on the switches status, thereby finding the proper opening.

It is desirable that the switch actuating motion be between the eyelid base and the eyelid. This avoids backlash associated with the linkage. It does however, constrain the location of the switches as the eyelid motion may not be in an optimal direction for switch actuation or the desired switch position will interfere with the mechanism at some point in it's travel. It is desirable to minimize the eyelid size by keeping the switches near the center of the mechanism, yet still be able to adjust their actuating position. A compact means for adjustment of the switch operating position is effected by the position of the setscrews 52. These setscrews which are located in multiple tapped holes 51 in the base 6 bear on a flexible actuator plate 53, which is divided into fingers 54. This, in turn, deflects the position of the switch actuating finger, normal to the plane of the plate. In this manner the multiple switches of the switch means 55 can be actuated at multiple eyelid positions to detect eyelid closure and print position and to provide a high voltage interlock. In a preferred embodiment of the present invention, these switches comprise Honeywell Microswitch UM40B switches, based on agency approval ratings and compact size. An additional switch 56, is mounted to the base to determine the service position. This switch is operated by contact with the rocker when the eyelid is opened to the service position. This switch requires no adjustment.

The high voltage interlock switch is connected to the coil of a relay controlling the high voltage to the charge leads. When the switch is not in contact with the actuation plate, the circuit is open, disabling the high voltage. The remaining switches provide logic signals to the print station of the eyelid position. Eyelid malfunction or removal is detectable by the print station, warning the operator and inhibiting certain operations.

The multiple electrical devices are connected by a flexible circuit board for ease of assembly. The switches are soldered on prior to mechanical assembly, the motor connected while assembling the eyelid, and final electrical connection to the printhead made at installation.

Figure 4:
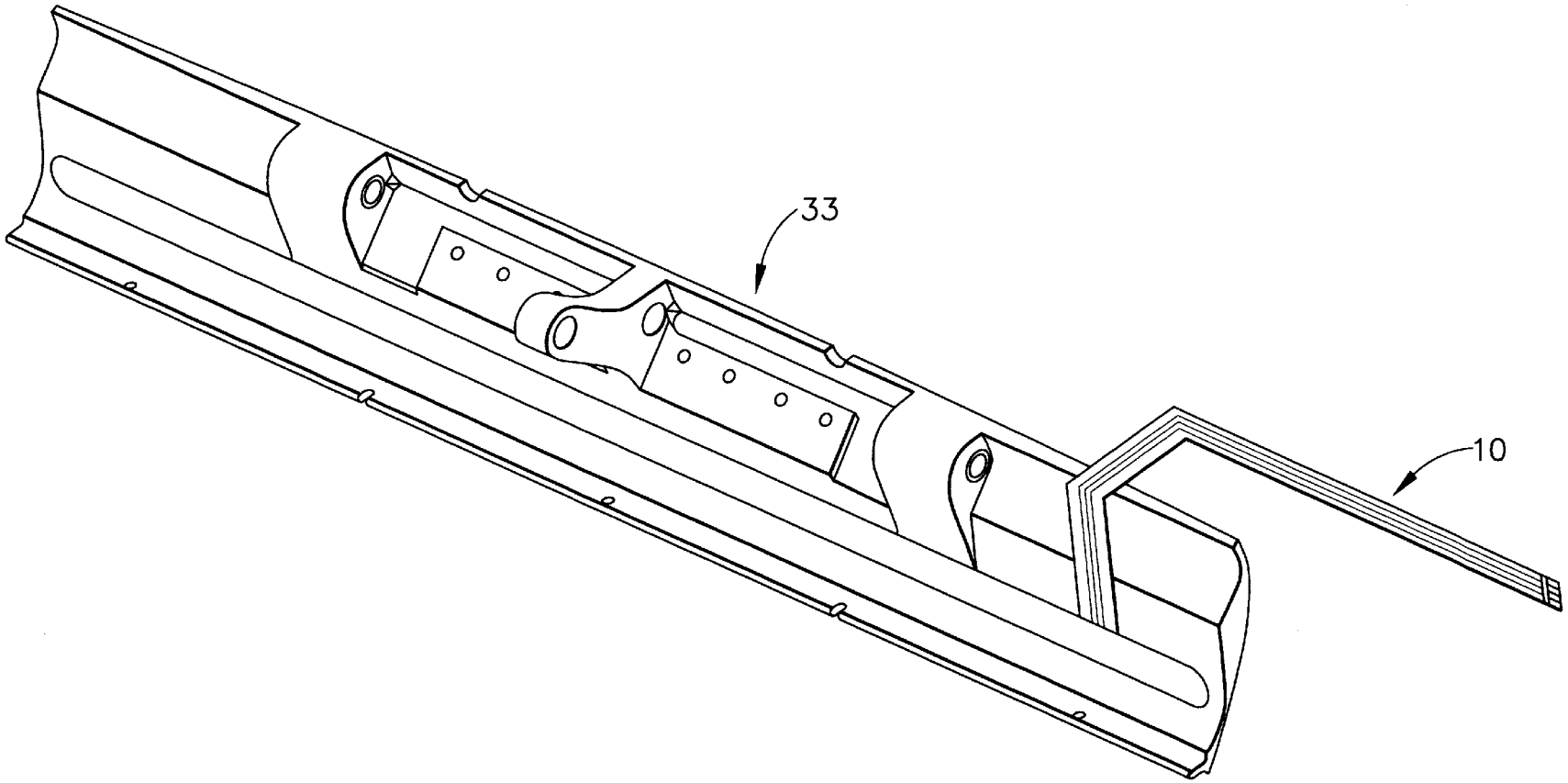
FIG. 4 illustrates an embodiment of the eyelid of the present invention with an attached heater flex.

In a further embodiment of the present invention, a flexible circuit heater 70 is attached to the inner surface of the eyelid, as shown in FIG. 4. The moisture from heated ink can saturate the air within the printhead with water vapor. This vapor then condenses on the cooler metal of the eyelid, leading to drops of water falling into the active area of the printhead. This may cause print disturbances or shorting of the charging electrodes. Heating the eyelid above the dew point keeps the condensate from forming. The voltage applied to the heater is varied in an open loop fashion, depending on the state of the printhead.

One embodiment of the eyelid also comprises a spring metal seal along its upper edge. This reduces air leakage around the eyelid while the eyelid is in the print and sealed positions. This spring metal seal also serves as an EMI shield, helping to contain the electronic noise produced inside the printhead.

In accordance with a preferred embodiment of the present invention, the eyelid seal is a rubber strip, molded to a nickel plated aluminum strip. It is detachable from the main body of the eyelid, allowing replacement of the seal in the field should it become damaged. In an alternate embodiment, the eyelid seal could be a molded or extruded rubber seal which is slid into a retaining groove formed in the body of the eyelid. In another embodiment, the rubber seal could be bonded to the eyelid body. These alternative embodiments are less desirable as they can not be as easily be replaced.

The invention has been described in detail with particular reference to certain preferred embodiments thereof, but it will be understood that modifications and variations can be effected within the spirit and scope of the invention.

What is claimed is:

1. An ink jet printer system, comprising:

a. an ink jet printhead having an ink drop generator, a catcher located adjacent to the ink drop generator, and a catcher pan located below the catcher;

b. an eyelid for sealing ink within the printhead on startup of the printer system;

c. an actuating means for transmitting movement to the eyelid along a predetermined non-circular curved path allowing for multiple positions of the eyelid; and d. an eyelid position sensing means for sensing position of the eyelid, comprising at least one switch and an adjustment means.

2. An ink jet printer system as claimed in claim 1 wherein the eyelid position sensing means is capable of determining the position of the eyelid along the predetermined path of motion.

3. An ink jet printer system as claimed in claim 2 wherein the actuating means comprises a multiple bar linkage system.

4. An ink jet printer system as claimed in claim 3 wherein the multiple bar linkage system comprises a four bar linkage.

5. An ink jet printer system as claimed in claim 1 further comprising switch means for determining position of the eyelid.

6. An ink jet printer system as claimed in claim 5 further comprising compact means to adjust operating position of these switches.

7. An ink jet printer system as claimed in claim 1 further comprising safety interlock means for disabling high voltage electrodes if the eyelid is opened beyond a predetermined maximum position.

8. An ink jet printer system as claimed in claim 1 further comprising a means for heating the eyelid to prevent formation of condensate on the eyelid.

9. An ink jet printer system as claimed in claim 1 wherein the actuating means comprises a motor.

10. An ink jet printer system as claimed in claim 9 wherein the motor comprises a stepper motor.

11. An ink jet printer system as claimed in claim 1 wherein the actuation means comprises means to locate the eyelid in at least three positions.

12. An eyelid assembly for a continuous ink jet printing system, the eyelid assembly comprising:

an actuating means for moving the eyelid to a plurality of positions;

eyelid guiding means for guiding the position of the eyelid; and switch means to determine position of the eyelid, the switch means comprising at least one switch and an adjustment means for adjusting operating position of the at least one switch.

13. An eyelid assembly as claimed in claim 12 wherein the eyelid position is along a predetermined non-circular path.

14. An eyelid assembly as claimed in claim 12 wherein the eyelid guiding means comprises a multiple bar linkage system.

15. An eyelid assembly as claimed in claim 14 wherein the multiple bar linkage system comprises a four bar linkage.

16. An eyelid assembly as claimed in claim 12 further comprising a means for heating the eyelid to prevent formation of condensate on the eyelid.

17. An ink jet printer system as claimed in claim 12 wherein the actuating means comprises a stepper motor.

* * * * *